US005795280A

United States Patent [19]

Fowler et al.

[11] Patent Number: 5,795,280

[45] Date of Patent: Aug. 18, 1998

[54] APPARATUS FOR THE REGISTRATION OF PRINTED MATTER DURING THE MANUFACTURE OF BAGS

[75] Inventors: Maxie Joe Fowler; William Belmont Osteen, both of Hodge, La.

[73] Assignee: Stone Container Corporation, Chicago, Ill.

[21] Appl. No.: 618,927

[22] Filed: Mar. 20, 1996

[51] Int. Cl.[6] ..... B65H 43/00; B31B 1/02

[52] U.S. Cl. ..... 493/22; 493/11; 493/24; 493/34; 493/188; 493/324

[58] Field of Search ..... 493/3, 1, 11, 13, 493/14, 15, 17, 18, 19, 22, 23, 24, 28, 29, 34, 35, 53, 54, 55, 187, 188, 320, 321, 322, 323, 324, 325

[56] References Cited

U.S. PATENT DOCUMENTS

| | | | |
|---|---|---|---|
| 3,397,505 | 8/1968 | Critchell | 493/10 |
| 3,977,309 | 8/1976 | Gilbert | 493/14 |
| 3,991,663 | 11/1976 | Glasby | 493/14 |
| 4,337,058 | 6/1982 | Lerner | 493/11 |
| 4,934,993 | 6/1990 | Gietmann | 493/11 |
| 5,000,725 | 3/1991 | Baukneckt | 493/11 |
| 5,041,070 | 8/1991 | Blaser | 493/18 |
| 5,292,299 | 3/1994 | Anderson | 493/15 |
| 5,417,638 | 5/1995 | Anderson | 493/14 |
| 5,447,486 | 9/1995 | Anderson | 493/15 |
| 5,470,300 | 11/1995 | Terranova | 493/22 |

*Primary Examiner*—Joseph J. Hail, III
*Assistant Examiner*—Christopher W. Day
*Attorney, Agent, or Firm*—Dick and Harris

[57] ABSTRACT

An apparatus for facilitating the registration of printed matter during the manufacture of bags on fixed-size bag formation equipment, from a continuous web of a substantially non-stretchable material. Printed matter, printed upon the continuous web at regularly-spaced intervals, includes a plurality of periodically spaced reference markers. While a finishing drum propels the continuous web in a direction of flow emanating from a supply of web material, at a substantially constant speed, feed rollers, positioned upstream from the finishing drum, propel the continuous web at a variable speed, relative to the substantially constant speed. As a cutting roller severs a substantially fixed length of web material from a leading edge of the web, at a substantially fixed position relative to an associated reference marker, downstream from the feed rollers, a programmable controller senses the passage of the reference marker past a predetermined position, and further senses the rotational positioning of the cutting roller, comparing these inputs to determine whether the web is being severed at a proper location. Subject to this sensing, a differential transmission adjusts the speed of the feed rollers, to, in turn, vary the position along the continuous web where the cutting roller severs the web in relation to the associated markers.

10 Claims, 1 Drawing Sheet

APPARATUS FOR THE REGISTRATION OF PRINTED MATTER DURING THE MANUFACTURE OF BAGS

BACKGROUND OF THE INVENTION

The present invention relates in general, to bag manufacturing apparatuses, and, more particularly, to apparatuses for facilitating the registration of printed matter during the manufacture of bags on fixed-size bag formation equipment.

In the manufacture of bags having printed matter thereon, care must be taken to properly place, or register, the printed matter within each individual bag, as individual bags are made from a continuous web of material having a repeating pattern of printed matter thereon. Small inaccuracies in the length of the web proximate the printed image upon a continuous web of paper, for example, and, in turn, the length of the bag being manufactured relative to the periodic spacing of the printed matter on the bag, can accumulate as successive bags are manufactured, causing the printed matter to rapidly fall out of registration (i.e., be improperly positioned as bags are formed). For example, an inaccuracy of 1/1000th of an inch per bag, accumulated over 1000 bags, can cause a one inch misalignment of the printed matter upon each successive bag. At manufacturing speeds of 500 bags or more per minute on conventional fixed-size paper bag machinery, relatively large print registration errors can occur in very short time frames. Accordingly, steps must be taken to precisely register the periodically printed matter upon the continuous web of material within associated, formed bags.

In general, there are two primary categories of conventional bag making machines: variable-size machines, and fixed-size machines. Both types of machines manufacture bags from a continuous tube which is formed from a continuous web of material.

In the operation of conventional variable-size machines, a tube is severed into individual bag lengths relatively early in the bag manufacturing process, prior to the formation of the bottom of the bag. This early severing of the tube creates a gap between the severed tube and the leading edge of the remainder of the web. This, in turn, facilitates the inclusion of a print registration apparatus with the variable-size bag manufacturing machine. Such a print registration apparatus may relatively easily vary the speed of the remainder of the web, inasmuch as a gap is created at the leading edge of the web, permitting a repositioning of the continuous web, or a variation in its speed, without upsetting the tension on the severed tube from which a bag will be formed.

In a conventional fixed-size bag machine, however, the individual tubes from which bags will be formed are not completely severed from the continuous web until late in the overall bag manufacturing process, when bag formation is nearly complete and delivery of the finished bag is imminent. Indeed, several bags are typically at varying stages of bottom formation at the time a leading bag is severed within fixed-size machines.

In general, conventional fixed-size bag machines are capable of significantly faster operation, with a significantly higher throughput, than conventional variable-size machines. However, because it was previously believed that the construction of fixed-size machines, and in particular the "delayed" severing of individual bags, did not lend themselves to the use of associated print registration systems, it was believed that in-line printing systems, rather than preprinted web material, must be employed to achieve properly registered printing upon the fixed-size equipment. Indeed, with fixed-size bag machines, because individual tubes are severed from the web so late in the manufacturing process, it was previously widely believed that there was no opportunity to alter the speed of the continuous web, to, in turn, reposition (i.e., register) the printed matter thereon, in order to compensate for inaccuracies between the spacing of the recurring printed image upon the web and the location of the severed fixed tube length of the bag being manufactured. Particularly when manufacturing bags from substantially non-stretchable materials, such as paper, it was believed that any attempt to reposition the continuous web, or alter the speed of a portion of the web in a fixed-size bag manufacturing machine, would be inoperative, due to frequent occurrences of tearing or breakage of the web, should variations in speed of a portion of the web, unsevered from the leading edge from which the fixed-size bags are being formed, be attempted.

It has been determined, quite unexpectedly, that speed variations can be made to a portion of the continuous web on an otherwise conventional fixed-size bag machine, even though portions of the continuous web proximate its leading edge, from which fixed-sized bags are being formed, are still attached to the continuous web and being driven by a finishing drum portion of the fixed-size bag making machine. Among other things, it has been discovered that there appears to be sufficient elasticity within webs of conventional paper material, and a certain degree of available slack or slippage of the web, within fixed-size bag machines, to permit such speed variations.

Accordingly, it is an object of the invention to provide an effective print registration system for use in association with a fixed-size bag manufacturing machine.

This and other objects and features of the present invention will become apparent in view of the present specification, drawings and claims.

SUMMARY OF THE INVENTION

The present invention comprises an apparatus for facilitating the registration of printed matter during the manufacture of bags on fixed-size bag formation equipment. The bags are formed from a substantially non-stretchable material. A supply of a continuous web of the substantially non-stretchable material is provided. The continuous web has a leading edge, a top surface, a bottom surface, and a plurality of periodically spaced printed matter disposed upon at least one of the top and bottom surfaces of the continuous web. The periodically spaced printed matter includes associated reference markers.

First web propelling means are provided for propelling the continuous web in a direction of flow emanating from the supply, at a substantially constant speed. This first web propelling means is operably positioned proximate a first position downstream from the supply. Second web propelling means are provided for propelling the continuous web at a variable speed, relative to the substantially constant speed of the web at the first position. The second web propelling means is operably positioned at a second position, between the supply and the first position.

First web severing means are provided for partially severing a substantially fixed length of the web material from the leading edge of the web, at a substantially fixed position relative to an associated reference marker. The web severing means is operably positioned downstream from the second position.

Bag forming means are provided for initiating the formation of the bag from the continuous web. The bag forming means is operably positioned downstream from the first web propelling means. Moreover, bag completion means are provided for completing the formation of the bag from the severed length of web material. The bag completion means is accordingly, operably positioned downstream from the web severing means. The bag completion means includes second web severing means for completing the partial severing of the substantially fixed length of web material from the leading edge of the web, at the substantially fixed position relative to the associated reference marker.

First sensing means are provided for sensing the passage of each of the reference markers past a third position, operably positioned downstream from the supply. The first sensing means outputs a first signal which is indicative of the passage of each of the reference markers. Second sensing means are further provided for sensing the rotational position of the web severing means. The second sensing means outputs a second signal which is indicative of the rotational position of the first and second web severing means.

Adjustment means, operably associated with the first and second sensing means, are also provided for comparing the first and second signals, and for adjusting the variable speed of the second web propelling means in accordance with the first and second signals. This, in turn, varies the position along the continuous web where the first and second web severing means sever the continuous web in relation to the associated reference markers. In this manner, bags are formed from substantially fixed lengths of web material severed from the web at substantially fixed positions relative to reference markers. Accordingly, the printed matter is positioned at predetermined locations upon associated formed bags.

In a preferred embodiment, the first and second web propelling means includes two counter-rotating pinch rollers. Moreover, in a preferred embodiment, the first web propelling means includes a finishing drum of the bag completion means.

Also, in a preferred embodiment, a first sensing means comprises an electronic scanner, and the second sensing means comprises a rotary shaft encoder.

Moreover, in a preferred embodiment, the adjustment means includes a differential transmission coupling the second web propelling means with the web severing means. This differential transmission preferably comprises a poly-infinitely-variable transmission. Also, in a preferred embodiment, the substantially non-stretchable material comprises a substantially paper material. This substantially paper material is preferably kraft paper having a basis weight of 25 to 90 pounds-per-ream.

DETAILED DESCRIPTION OF THE DRAWINGS

Figures 1, 2, 3, 4, 5:
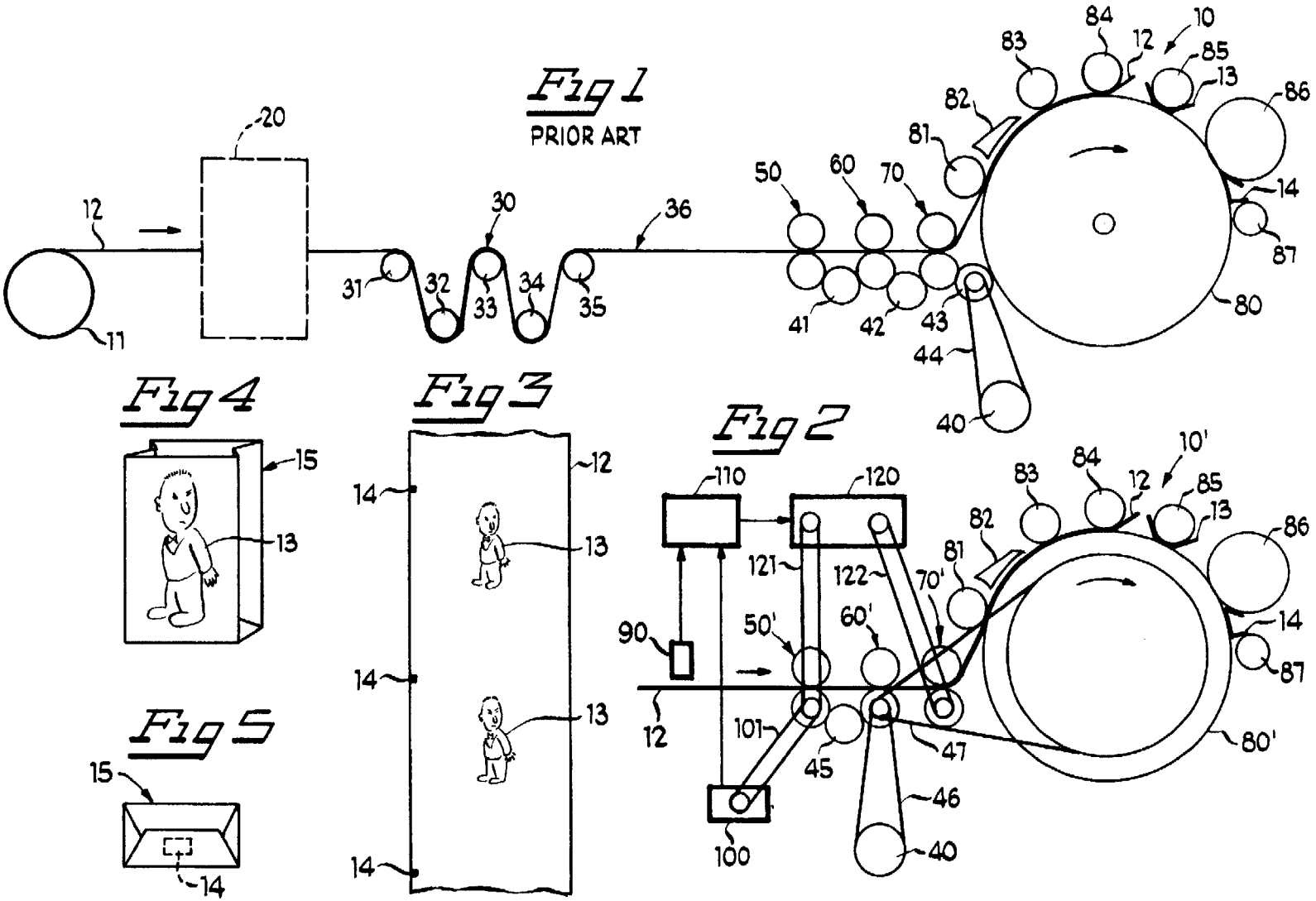
Fig 1 PRIOR ART
FIG. 1 of the drawings is an elevated, side schematic view of a prior art fixed-size bag manufacturing apparatus.
FIG. 2 of the drawings is an elevated, side schematic view of a portion of a fixed-size bag manufacturing apparatus including a print registration system.
FIG. 3 of the drawings is a plan view of a portion of a continuous web of material showing, in particular, the periodically-spaced printed matter and reference markers printed thereon.
FIG. 4 of the drawings is a perspective view of a deployed, fully formed bag showing, in particular, the proper registration of the printed matter of FIG. 3 upon the bag.
FIG. 5 of the drawings is a bottom view of the deployed, fully formed bag of FIG. 4 showing, in particular, the concealment of a reference marker within a bottom fold of the bag.

While this invention is susceptible of embodiment in many different forms, there is shown in the drawings and will herein be described in detail, one specific embodiment, with the understanding that the present disclosure is to be considered as an exemplification of the principals of the present invention and is not intended to limit the invention to the embodiment illustrated.

A prior art, fixed-size bag manufacturing apparatus 10 is shown in FIG. 1 as comprising a supply 11 of a continuous web of substantially non-stretchable material 12, optional in-line printing system 20, S-wrap unit 30, drive motor 40, thumb cut rollers 50, scoring rollers 60, and web propelling means, including feed rollers 70 and finishing drum 80. Supply 11 of continuous web 12 may comprise a roll of substantially non-stretchable material, such as a substantially paper material, preferably initially of a substantial length, such that a significant number of bags may be formed by apparatus 10 without the necessity of changing or replacing supply 11.

In this prior art embodiment, if desired, an optional in-line printing system 20 may be included, permitting printed matter including designs, patterns or other indicia to be periodically printed upon the continuous web 12, spaced such that they are shown upon individual bags as they are subsequently severed and formed from the continuous web. It was previously believed that in-line printing was necessary to achieve proper print-registration upon conventional fixed-size machines. With the invention of FIG. 2, however, numerous advantages in omitting in-line printer 20 may be achieved by instead using a pre-printed continuous web 12, wherein the printed matter has been printed upon the web "offline". For example, in-line printer 20 may be a "bottleneck" with respect to the overall speed, or throughput, of bag manufacturing apparatus 10. The omission of an in-line printer in favor of pre-printed webs of material may permit a significant increase in the operational speed of the bag manufacturing apparatus. Moreover, it is often impractical to print a large quantity of colors with in-line printing systems. Accordingly, the use of pre-printed web material facilitates the manufacturing of bags having a larger variety of colors within the displayable designs or indicia thereon.

S-wrap unit 30, including a plurality of rollers such as rollers 31, 32, 33, 34, and 35, maintains tension upon continuous web 12 as it is drawn from supply 11 or in-line printer 20.

At position 36 of FIG. 1, the side edges of continuous web 12 are folded about a conventional tube former (not shown), as continuous web 12 is rolled from a substantially flat orientation to a substantially tubular orientation as the continuous web is drawn from supply 11 and in a direction of flow from left to right as FIG. 1 is viewed, forming a continuous tube. Following this formation, thumb cut rollers 50 make a semicircular, "thumb cut" proximate what will become a top opening of an individual bag, once an associated tube is subsequently severed from the continuous web. When individual bags are fully formed, this thumb cut, made through what will subsequently become a front panel of the bag, facilitates gripping of only a back panel of a bag, to, in turn, facilitate opening of a completed, folded bag. Thumb cut rollers 50 include a top roller, having a transverse cutting knife disposed upon an outer surface of the roller, and a counter-rotating bottom roller. Scoring rollers 60 then place transverse score lines upon continuous web 12, transverse to the direction of travel of continuous web 12. As individual bags are subsequently severed and formed, each score line will facilitate the folding of an associated collapsed, undeployed bag. Preferably, scoring rollers 60 comprise two counter-rotating rollers, including an upper roller and lower roller. One roller has a male scoring member, while the other has a corresponding, female groove, rotatably aligned with the male scoring member.

Downstream from scoring rollers 60 are feed rollers 70, comprising two additional counter-rotating rollers adjacent the top and bottom surfaces of the continuous web 12. Feed rollers 70 serve to propel continuous web 12 from supply 11, through thumb cut rollers 50 and scoring rollers 60, towards finishing drum 80. Downstream from feed rollers 70 is finishing drum 80, including multiple associated, counter-rotating stations for completing formation of individual bags. At station 81, regions of the continuous tube which will comprise the bottoms of associated bags are partially severed by a first web severing means to facilitate the initiation of bottom formation. In particular, all but approximately 1.5 inches of the circumference of the continuous tube is severed at this time. Then, at station 82, bottom formers begin the process of folding the tube of web material towards constructing bag bottoms, while at station 83, paste is applied to a portion of what will become the bottom of each bag, towards sealing a finally folded bottom, while at station 84, a first bottom tuck is formed towards the formation of each bag's bottom. Moreover, a final cut is made at this station by a second web severing means, severing the top opening of what will become a leading bag from what will become the bottom closure of the next bag in sequence. Stations 81 and 84 both include rotary cutting blades, transverse to the direction of flow of continuous web 12 and counter-rotating with finishing drum 80. A "preliminary" cut is made at station 81, while at station 84, relatively late during the bag formation process, a predetermined length of tubed material is finally severed from a leading edge of the web. A second bottom tuck occurs at station 85, to the bottom of severed tube 13 from continuous web 12. Next, at station 86, final bottom folds are made, creating a folded bag 14, which is pressed into a fully folded, collapsed orientation by press roller 87.

As shown in FIG. 1, prior art bag manufacturing apparatus 10 includes a unitary drive mechanism, wherein each of thumb cut rollers 50, scoring rollers 60, feed rollers 70, and finishing drum 80 are driven by a fixed power transmission means from motor 40. This unitary drive mechanism is illustrated schematically in FIG. 1 by belt 44 and gears 41, 42, and 43. This drive mechanism is constructed such that the outer circumferential surface, tangential speed of each of thumb cut rollers 50, scoring rollers 60, feed rollers 70, and finishing drum 80 (including each counter-rotating station of the finishing drum) are substantially identical and responsive to a rotational speed of motor 40, such that continuous web 12 is propelled through each of these elements at substantially the same linear speed proximate each such element.

Particularly when using webs of pre-printed material, the spacing of the printed matter upon the web may vary slightly. This may occur, for example, as wet paper is intermittently stretched slightly as it is wound around the circumference of a take-up roll following the printing operation. Moreover, wear may occur upon the various rollers transporting and propelling the web, causing occasional web slippage and slight variations in the overall length of travel of the web.

It must be assured that periodically spaced printed matter disposed upon a printed, continuous web is aligned and "timed" properly with the bag severing and formation processes, such that each instance of printed matter upon the continuous web is properly registered upon an outer surface of an associated, fully formed bag. Otherwise, should the bag manufacturing apparatus not be in complete synchronization with the spacing of the printed matter upon the continuous web, the cutting and forming of the bags may be out of registration relative to the printed matter, such that the printed matter is not properly placed upon desired locations of the fully formed bags. In addition to the above-described printing variations, out of registration conditions may also arise due to variations and wear upon the surfaces of drive rollers propelling the continuous web.

A portion of continuous web 12 is shown in detail in FIG. 3 as including a plurality of periodically and substantially evenly-spaced printed matter 13; each including an associated periodically spaced reference marker 14 at a predetermined position relative to the remainder of printed matter 13 and preferably along a side edge of continuous web 12. Continuous web 12 is preferably made of conventional kraft paper, having a basis weight of 25 to 90 pounds-per-ream. Continuous web 12 is preferably severed during the bag formation process at web severing means 84 transversely across the continuous web, either directly at each reference maker 14 or at a predetermined, fixed distance relative to each reference marker 14. This, in turn, assures that each printed matter 13 associated with a particular reference marker 14 will be positioned, or registered, at a proper position upon an outer surface of a bag as each individual bag is formed. As shown in FIG. 4, for example, each length of tube is preferably severed relative to an associated reference marker, such that a regularly spaced printed matter 13 is situated, and entirely contained, within a front or back panel of an associated, fully formed bag 15. Moreover, as shown in FIG. 5, each reference marker 14 is preferably positioned, relative to an associated transverse cut severing a portion of the continuous web for bag formation, such that when bag 15 is fully formed, its associated reference marker 14 is located at a relatively inconspicuous location, such as within a bottom fold of the fully formed bag.

Although, in the illustrated embodiment of FIG. 3, each reference marker is separate from the remainder of its associated printed matter, it is also contemplated that the reference marker may comprise an integral portion of the printed matter itself, such as the "shoe" of the printed character of FIG. 3, or any other portion of the printed matter having sufficient contrast relative to the paper web to trigger an optical sensor.

Moreover, while the illustrated embodiment of FIG. 3 shows a reference marker associated with each instance of printed matter along the web, it is also contemplated that fewer reference markers may be used. For example, a single reference marker may be associated with a group of two or more instances of printed matter. In such cases, the print registration process, as described herein, will not potentially occur once per bag; but will instead occur at most once per group of bags corresponding to the group of instances of printed matter sharing a common reference marker.

The addition of a print registration system to the prior art fixed-size bag manufacturing apparatus 10 of FIG. 1 is shown in FIG. 2. The prior art fixed-size bag manufacturing machinery modified with the present invention may comprise, for example, a Potdelvin model 835 ⅙ barrel sack machine, distributed by the H. G. Weber Co. of Kiel, Wis. Modified bag manufacturing apparatus 10' includes electronic scanner 90, rotary shaft encoder 100, programmable controller 110, and differential transmission 120. Scanner 90 is located proximate the top surface of continuous web 12, and in substantial alignment with the path of the reference markers 14, as they travel beneath scanner 90 along the direction of flow of the continuous web from supply 11. As each reference marker 14 passes beneath and past scanner 90, scanner 90 generates an electronic signal to programmable controller 110, essentially instantaneously indicating the passage of an individual reference marker beneath the location of the scanner. Scanner 90 preferably includes a conventional photocell, sensing light reflecting off of the continuous web. The sensitivity of the photocell may be adjusted such that the difference in contrast between the reference markers and the remainder of the continuous web travelling beneath the photocell is sufficient to trigger the electronic signal to the programmable controller. Scanner 90 may comprise a conventional color scanner, such as those supplied by Electronic Machine Parts, Inc. of College Point, N. Y.

Alternatively, reference markers 14 may be printed using a magnetic ink, in which case scanner 90 will include an associated magnetic sensor, rather than an optical sensor.

Thumb cut rollers 50', scoring rollers 60', and finishing drum 80' all share a common, unitary drive mechanism, such that their outer surfaces have a substantially equal surface tangential speed responsive to the speed of motor 40. This common drive mechanism is illustrated schematically in FIG. 2 by gear 45, belt 46, and belt 47.

As shown in FIG. 2, rotary shaft encoder 100 is coupled to the lower roller of thumb cut rollers 50', such as by a belt 101. Shaft encoder 100 outputs an electrical signal to programmable controller 110, indicating the current rotational orientation of the lower thumb cut roller of 50'. Moreover, inasmuch as upper thumb cut 50' counter rotates with the lower thumb cut roller, this, in turn, enables shaft encoder 100 to output a signal indicative of the current orientation of the cutting blade of thumb cut roller 50'. Inasmuch as thumb cut rollers 50', scoring rollers 60', finishing drum 80' and, in turn, its associated counter-rotating stations share a common, unitary drive mechanism coupled to motor 40, shaft encoder 100 simultaneously outputs an electrical signal, in the form of a peak, set-point pulse, which is indicative of an alignment of the transverse knife edges of both preliminary cut station 81 and final cut station 84 with finishing drum 80'. These set-point pulses repeat periodically, once for each rotation of stations 81 and 84. Accordingly, the set-point pulse signal indicates to programmable controller 110 precisely when an individual tube is severed from the leading edge of the continuous web. Rotary shaft encoder 100 may comprise, for example, a model B2369 encoder supplied by Electronic Machine Parts, Inc. of College Point, N.Y.

Differential transmission 120 couples thumb cut rollers 50', and, in turn, via their common drive mechanism scoring rollers 60' and finishing drum 80', to feed rollers 70', such as via an input belt 121. Differential transmission 120 preferably comprises a conventional poly-infinitely-variable transmission, enabling the speed of an output belt 122, and, in turn, the rotational speed of feed rollers 70', to be varied in relation to the rotational speed of input belt 121, and, in turn, the common surface tangential speeds of thumb cut rollers 50', scoring rollers 60', and finishing drum 80'. The particular setting of differential transmission 120 is electrically controlled by a signal emanating from an output port of programmable controller 110. Differential transmission 120 may comprise, for example, a model DDT-2 transmission supplied by Electronic Machine Parts, Inc. of College Point, N. Y.

Programmable controller 110 preferably includes a conventional microprocessor or microcontroller, including associated random access memory and read only memory, containing program codes and data for execution by the microprocessor/microcontroller. Programmable controller 110 further includes input ports, for reading the above-described signals output from scanner 90 and shaft encoder 100, as well as output ports, for controlling the setting of differential transmission 120. Programmable controller 110 may comprise, for example, a series 2500 controller supplied by Electronic Machine Parts, Inc. of College Point, N. Y.

In operation, programmable controller 110 will initially set differential transmission 120 to a setting, wherein the tangential surface speed of feed rollers 70', and, in turn, the driven speed of continuous web 112 proximate feed rollers 70', is substantially equal to the tangential surface speeds of thumb cut rollers 50', scoring rollers 60', and finishing drum 80'. Throughout the duration of the operation of bag manufacturing apparatus 10', as portions of continuous web 12 containing reference markers pass beneath scanner 90, and as bags are being formed, imparting rotation of rotary shaft encoder 100, programmable controller 110 will continuously receive the output signals from scanner 90 and shaft encoder 100, and perform continuous comparisons of the two outputs. For printed matter upon continuous web 12 to be properly registered within each of the associated, individually formed bags, the rotational orientation of the cutting knife of final cut station 84, as sensed by shaft encoder 100, must coincide, either simultaneously, or at a fixed, anticipated time or distance delay, relative to the sensing of a reference marker 14 passing beneath scanner 90.

Should an output signal from scanner 90 occur earlier than anticipated, relative to an associated, anticipated set-point pulse output from shaft encoder 100, a retard condition will be deemed to occur by programmable controller 110. Whenever a retard condition occurs, programmable controller 110 will send a signal to differential transmission 120, slightly increasing the speed of feed rollers 70'. This speed increase will be proportionate to the quantity of error detected, as determined by the time/distance variation between the measured and anticipated respective timings of the signals received from the scanner and the shaft encoder, and typically an amount sufficient to increase the overall length of a severed bag by approximately 1/1000th to 2/1000th of an inch.

Similarly, should the output of scanner 90 occur at a later than expected time, relative to a received set-point pulse from rotary shaft encoder 100 indicating the severing of a tube from the leading edge of the continuous web by stations 81 and 84 of finishing drum of 80', an advance condition will be deemed by programmable controller 110 to have occurred. Whenever an advance condition occurs, programmable controller 110 will instruct differential transmission 120 to momentarily slow the speed of feed rollers 70'. This momentary variation of speed will again be proportionate to the quantity of error detected, as determined by the time/distance variation between the measured and anticipated respective timings of the signals received from the scanner and the shaft encoder, again typically amounting to an approximately 1/1000th to 2/1000th decrease in the length of a bag, as severed by stations 81 and 84 of finishing drum 80'.

Isolated advance conditions or retard conditions will be deemed to be random errors, such as may occur due to occasional slippage among the various rollers transporting the continuous web during the manufacturing process, or isolated variations in the position of printed matter upon the web. These momentary speed adjustments will occur for approximately the duration of a single bag's travel beneath scanner 90, as determined by the passage of individual reference markers 14. Following each such momentary adjustment, programmable controller 110 will instruct differential transmission 120 to return to its prior speed setting. However, should a programmable, predetermined number of contiguous advance conditions, or a programmable, predetermined number of contiguous retard conditions occur, a constant length error will be deemed to have occurred. In a preferred embodiment, the predetermined numbers of both contiguous advance and retard conditions are set to 10. Should a constant length error be deemed to occur, a "permanent" change, again typically equal to approximately 1/1000th to 3/1000th of an inch per bag at the rate of travel of the continuous web, will be made to feed rollers 70', and a "new" set-point speed for feed rollers 70' will be deemed to be established at the modified speed. Thereafter, programmable controller 110 will continue to compare and analyze the outputs of scanner 90 and rotary shaft encoder 100, again determining whether additional retard conditions, advance conditions, random errors, and constant length errors occur, and taking additional, corrective actions in the manner described above.

An additional advantage of the present invention of FIG. 2 is the ability to accommodate otherwise incompatible printing presses and bag making machines. For example, pre-printed rolls of continuous webs of material may be printed using a printing press having a 20 inch repeat printing length; i.e., capable of repeating a pattern of printed matter every 20 inches along the length of the web. An existing, commercially available prior art fixed-size bag manufacturing machine, such as shown in FIG. 1, may be geared to accommodate print lengths of 20.062, rather than 20 inches. By retrofitting such a prior art machine to include the print registration system of FIG. 2, the prior art machine may compensate for the 0.062 inch variation in print length, such that bags may be formed with properly registered printed matter thereon, regardless of the prior incompatibility between the printing press and the fixed-size bag making machine. Overall, it is believed that web positioning adjustments up to 1/8" can be achieved on fixed-size bag manufacturing equipment with the present invention.

The foregoing description and drawings merely explain and illustrate the invention and the invention is not limited thereto, except insofar as the appended claims are so limited, as those skilled in the art who have the present disclosure before them will be able to make modifications and variations therein, without departing from the scope of the invention.

What is claimed is:

1. An apparatus for facilitating the registration of printed matter during the manufacture of bags on fixed-size bag formation equipment, said bags being formed from a substantially non-stretchable material, said apparatus comprising:

a supply of a continuous web of said substantially non-stretchable material, said continuous web having a leading edge, a top surface, a bottom surface, and a plurality of periodically spaced printed matter disposed upon at least one of said top and bottom surfaces of said continuous web, said periodically spaced printed matter including associated reference markers, first web propelling means for substantially, continuously propelling said continuous web in a direction of flow emanating from said supply and at a substantially constant, uninterrupted speed, said first web propelling means being operably positioned proximate a first position downstream from said supply;

second web propelling means for propelling said continuous web at a variable speed relative to said substantially constant speed of said web at said first position, said second web propelling means being operably positioned proximate a second position between said supply and said first position, upstream of said first web propelling means;

first web severing means for partially severing a substantially fixed length of web material from said leading edge of said web at a substantially fixed position relative to an associated reference marker, said web severing means being operably positioned downstream from said second position;

bag forming means for initiating the formation of said bag from said continuous web, said bag forming means being operably positioned downstream from said second web propelling means;

bag completion means for completing the formation of said bag from said severed length of web material, said bag formation means being operably positioned downstream from said first web severing means, said bag completion means including second web severing means for completing said partial severing of said substantially fixed length of web material from said leading edge of said web at said substantially fixed position relative to said associated reference marker;

first sensing means for sensing the passage of each of said reference markers past a third position operably positioned downstream from said supply, said first sensing means outputting a first signal indicative of said passage of each of said reference markers;

second sensing means for sensing the rotational positions of said first and second web severing means, said second sensing means outputting a second signal indicative of said rotational positions of said first and second web severing means;

said position of said first sensing means and said rotational positions of said first and second web severing means being operably correlated so that, upon passage of at least one of said reference markers past said first sensing means during a predetermined interval of time, said first and second severing means sever said web at desired predetermined positions relative to said periodically spaced printed matter;

web speed altering means, operably associated with the second sensing means and the second web propelling means, for selectively increasing or decreasing the speed of the second web propelling means to, in turn, increase or decrease the speed of a localized portion of the web upstream of the first severing means, relative to other portions of the web; and web control means, operably associated with the first sensing means for receiving said first signal therefrom, and said second sensing means for receiving said second signal therefrom, for determining from the first and second signals whether a localized portion of the web, located between the first sensing means and a selected fixed location downstream thereof, is moving at a speed varying from a preselected speed;

the web control means further being operably associated with said speed altering means, for increasing said speed of said second web propelling means relative to said first web propelling means when said localized portion of said web is moving below a preselected speed and for decreasing said speed of said second web propelling means relative to said first web propelling means when said localized portion of said web is moving above a preselected speed, to, in turn, vary the speed of said localized portion of said web, to vary the position along the continuous web where said first and second web severing means sever said continuous web in relation to said associated reference marker;

first information transmitting means for communicating said first signal from said first sensing means to said web control means;

second information transmitting means for communicating said second signal from said second sensing means to said web control means; and means for communicating control signals between said web control means and said web speed altering means.

2. The apparatus according to claim 1 wherein said second web propelling means includes two counter-rotating rollers.

3. The apparatus according to claim 1 wherein said first web propelling means includes a finishing drum of said bag completion means.

4. The apparatus according to claim 1 wherein said first sensing means comprises an electronic scanner.

5. The apparatus according to claim 1 wherein said second sensing means comprises a rotary shaft encoder.

6. The apparatus according to claim 1 wherein said speed altering means includes a differential transmission coupling said second web propelling means with said first and second web severing means.

7. The apparatus according to claim 6 wherein said differential transmission comprises a poly-infinitely-variable transmission.

8. The apparatus according to claim 1 wherein said substantially non-stretchable material comprises a substantially paper material.

9. The apparatus according to claim 8 wherein said substantially paper material comprises kraft paper.

10. The apparatus to claim 9 wherein said kraft paper has a basis weight within a range of 25 to 90 pounds-per-ream.

* * * * *